US009027235B2

(12) United States Patent
Eichelmann

(10) Patent No.: US 9,027,235 B2
(45) Date of Patent: May 12, 2015

(54) METHOD OF PRODUCING A BRAID COMPRISING A PLURALITY OF WIRES

(75) Inventor: Klaus Eichelmann, Teltow (DE)

(73) Assignee: DLB Draht und Litzen GmbH, Berlin (DE)

( * ) Notice: Subject to any disclaimer, the term of this patent is extended or adjusted under 35 U.S.C. 154(b) by 765 days.

(21) Appl. No.: 12/737,090

(22) PCT Filed: Jun. 5, 2009

(86) PCT No.: PCT/EP2009/004049

§ 371 (c)(1),
(2), (4) Date: Dec. 6, 2010

(87) PCT Pub. No.: WO2009/146928

PCT Pub. Date: Dec. 10, 2009

(65) Prior Publication Data

US 2011/0186332 A1 Aug. 4, 2011

(30) Foreign Application Priority Data

Jun. 6, 2008 (DE) ..... 10 2008 027 295

(51) Int. Cl.
*H01R 43/00* (2006.01)
*H01B 7/00* (2006.01)
*H01B 13/02* (2006.01)

(52) U.S. Cl.
CPC ..... *H01B 7/0009* (2013.01); *H01B 13/0285* (2013.01)

(58) Field of Classification Search
CPC ..... H01B 7/0009; H01B 13/0285
USPC ..... 29/825, 872; 72/261; 174/128.1
See application file for complete search history.

(56) References Cited

U.S. PATENT DOCUMENTS

| | | | | | |
|---|---|---|---|---|---|
| 251,114 | A | * | 12/1881 | Glazw | 57/215 |
| 3,383,704 | A | * | 5/1968 | Schoerner et al. | 57/215 |
| 3,444,684 | A | * | 5/1969 | Schoerner et al. | 57/9 |
| 4,471,527 | A | * | 9/1984 | Nishijima | 29/872 |
| 4,778,246 | A | * | 10/1988 | Carroll | 385/107 |
| 5,133,121 | A | * | 7/1992 | Birbeck et al. | 29/872 |

(Continued)

FOREIGN PATENT DOCUMENTS

| | | | |
|---|---|---|---|
| EP | 1 191 545 | A1 | 3/2002 |
| JP | 4372313 | * | 12/1992 |
| JP | 06 060739 | A | 3/1994 |

OTHER PUBLICATIONS

DIN 17 666, published by Deutsches Institut fuer Normung e.V., Berlin, Germany (Dec. 1983).

(Continued)

*Primary Examiner* — Carl Arbes
(74) *Attorney, Agent, or Firm* — Kriegsman & Kriegsman

(57) ABSTRACT

The invention relates to a method for the production of a strand (11) of several wires (12), consisting of an electrically conductive material, which are hard drawn to a final diameter in at least a single or multiblock wire-drawing machine (19, 28) or drawing apparatus in a last drawing step before the stranding, so that in each case the wire or wires (12) have a tensile strength of at least 300N/mm$^2$, and that subsequently the hard drawn wires (12) or a mixture of hard drawn wires (12) and soft-annealed wires are stranded into a strand (11) in a stranding machine (21), without a subsequent annealing process, as well as a strand which is produced according to the present method.

13 Claims, 3 Drawing Sheets

(56) References Cited

U.S. PATENT DOCUMENTS

Figure 4:
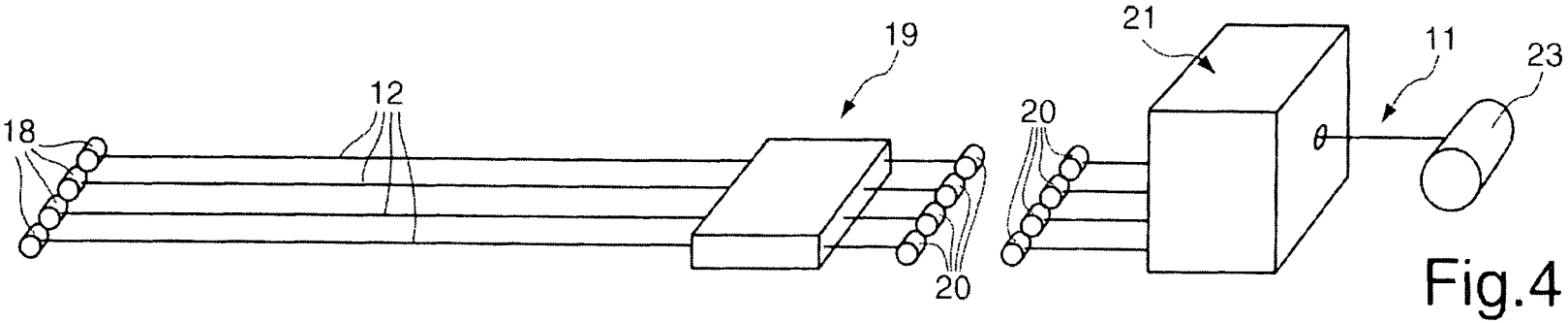

| | | | | |
|---|---|---|---|---|
| 5,223,349 | A * | 6/1993 | Kudo et al. | 428/652 |
| 5,496,969 | A * | 3/1996 | Blackmore | 174/113 R |
| 6,272,828 | B1 * | 8/2001 | Walling et al. | 57/58.49 |
| 6,313,409 | B1 * | 11/2001 | Bales et al. | 174/128.1 |
| 6,449,834 | B1 * | 9/2002 | Bales et al. | 29/825 |
| 8,429,812 | B2 * | 4/2013 | Yoshinaga et al. | 29/825 |
| 2003/0037957 | A1 * | 2/2003 | Ueno et al. | 174/128.1 |

OTHER PUBLICATIONS

DIN EN 13602, published by Deutsches Institut fuer Normung e.V., Berlin, Germany (Sep. 2013).

International Standard ISO 1187, published by International Organization for Standardization, Geneva, Switzerland (1983).

International Standard ISO 1336, published by International Organization for Standardization, Geneva, Switzerland (1980).

* cited by examiner

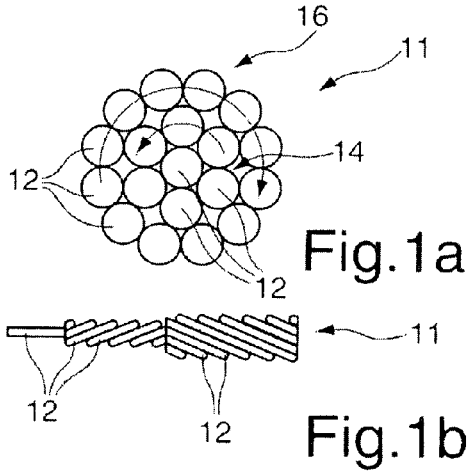
Fig.1a
Fig.1b
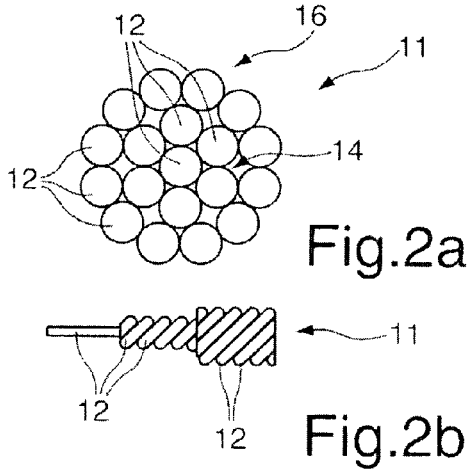
Fig.2a
Fig.2b
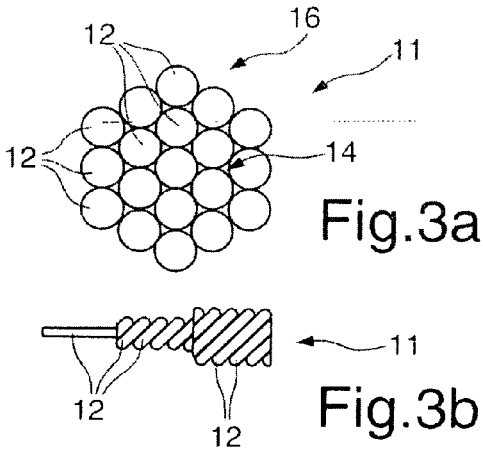
Fig.3a
Fig.3b

METHOD OF PRODUCING A BRAID COMPRISING A PLURALITY OF WIRES

The invention relates to a method for the production of a strand of several wires, as well as a strand of several wires, which is intended in particular as an electrical conductor for motor vehicles.

The application of electrical conductors for motor vehicles, which are implemented with multi-wires and are made of copper, is generally known. For example, electrical conductors of this type originate from ISO 6722. These strands can comprise of 7, 12, 16, 19, 24 or 32 wires. Strands of this type can be designed as choke strands or core strands. For example, a core strand includes a central wire, around which one or several layers of wire are arranged concentrically. In the method, for example, an arrangement of 1+6 or 1+6+12 or 1+6+12+18 wires is given. Core strands with the layers of wire having the same impact direction will be denoted as so-called unilay-core strands. Core strands of this type with a different impact direction will be denoted as True-Concentric core strands.

For the production of the present strands particularly used in motor vehicles, wires are used, which are drawn to a predetermined diameter on a multiblock wire-drawing machine. Subsequently, these drawn wires pass through an annealing furnace or an annealing device, in which a recrystallisation of the structure of the drawn wire is carried out. In this method, the wires are heated with an annealing current of 2,000 A for example, by an annealing conductor of 80 KW, for example, in order to soft-anneal the wires again which become brittle during the drawing method. The annealing treatment takes place in an environment consisting predominantly of nitrogen. Subsequently these wires are coiled in a winder onto a spool and stored, in order to subsequently supply a stranding machine with the soft-annealed wires. For instance, core strands with seven wires and a total cross-section of 0.35 $mm^2$, for example, with the wire having a diameter of 0.25 mm, for example, are produced by this machine. Core strands of this type are required by the motor vehicle industry, since these core strands meet the demands on tensile strength, fatigue strength with bending stresses and further stress parameters. For the transmission of electric signals, a core strand of this type is over dimensioned with a cross section of 0.35 $mm^2$, for example.

Due to the increasing prices of raw materials, and the option of reducing the total cross-section of the strand, it has already been suggested that brass wires are used instead of copper wires. This embodiment is advantageous in that with a smaller cross-section, the tensile strength, fatigue strength with bending stresses are given, however the material costs are higher than with copper.

Furthermore, for saving copper in production of strands of this type, it is suggested that in the place of copper, aluminium is used. Indeed, this facilitates a reduction in weight and cost, however due to the material qualities of an aluminium alloy, it is necessary to increase the overall cross-section of the strand.

A further solution option was designed, whereby a central wire is formed of steel, and this steel wire is surrounded by a copper casing. Through this embodiment, again a thinner cross-section and saving of material are given, at the same time as fulfilling the requirements on tensile strength, however not the fatigue strength with bending stresses. Furthermore, the production method is very expensive and complex. In addition, there can be problems with cutting a construction of this type to length, due to the very hard core in relation to the soft copper casing. Equally, there can be recycling problems and problems of electrocorrosion due to the material pairing.

Furthermore, the last suggested arrangement of a strand is modified in that effect, as instead of a copper casing, a layer of wires, of wires which are made of copper, is provided around a steel core. This design is disadvantageous in that different types of material are to be recycled, and in addition, there can be difficulties in cutting the electrical conductor to length due to the different hardness. Equally, due to the material pairing, there can be problems of electrocorrosion.

In a further embodiment of a strand with soft-annealed wires, one or more Kevlar fibres are incorporated, in order to increase the tensile strength. This embodiment is disadvantageous in that production is expensive due to the use of Kevlar fibres. In addition, there can be problems with recycling and with cutting the conductor to length.

Therefore the object of the invention is to create a strand, which allows for saving material, and preferably a reduction of the cross-section, and where at least the mechanical and electrical properties of the present strand with soft-annealed copper wires are maintained.

According to the invention, this object is achieved by a procedure according to the features of claim 1, and a strand according to the features of claim 11. Further advantageous embodiments and further developments are indicated in the further respective dependent claims.

The method according to the invention is for the production of a strand of several wires, in which one or several wires, hard drawn through at least one single and/or multiblock wire-drawing machine and/or drawing device in one or several drawing steps, and/or one or several wires hard drawn in a last drawing step before the stranding, and/or one or several further wires treated with an annealing process are twisted into a strand, with the hard drawn wires comprising a tensile strength of at least 300N/$m^2$. It is advantageous, that a strand of this type, in comparison with a strand made exclusively of soft-annealed wires, has a smaller total cross-section and at least the same mechanical properties. Surprisingly, it has been shown that the wire(s) hard drawn through a single and/or multiblock wire-drawing machine, or a single and/or multiblock wire-drawing machine in at least a last drawing step before the stranding, indeed feature an increased brittleness, however this brittleness, after the twisting of the hard drawn wires or the hard drawn unannealed wires with the further soft-annealed wires to form a strand, does not lead to a premature break of the strand. A strand of this type, which consists in particular exclusively of hard drawn wires, surprisingly meets the requirements of the mechanical properties, such as for example fatigue strength with bending stresses or tensile strength. Due to this completely surprising knowledge, a procedure for the production of wires for the strand can thus be created, which builds on the current technology, and facilitates a higher processing speed. This surprising knowledge additionally leads to not only a considerable saving of material, and thus a saving of cost, but also a gain of installation space, through the use of smaller total cross-sections of the strand.

According to a first advantageous embodiment of the method it is intended that the planned number of wires for the strand is produced in one or several drawing steps in at least a single or multiblock wire-drawing machine or drawing apparatus, and without an annealing process is wound onto a winder or spool(s). Through this, a reduction of the production costs is made possible, due to the complete saving of the cost of nitrogen used during the annealing process and also of the high energy use during the annealing process. Simultaneously, a reduction of the length of the procedure for the production of hard drawn and unannealed wires of this type can be achieved. In addition it is possible to ensure that the same quality of wires for the stranding procedure is provided and is processed in the strand. Therefore, a homogenous processing can come about, due to the same material properties of the wires. It can also be ensured that during stresses occurring on the strand, the wires do not work their way out towards the further stranded wires.

According to an alternative embodiment of the method, it is preferably intended that a number of the wires hard drawn in the single or multiblock wire-drawing machine or drawing apparatus, which remain unannealed, and a further number of the wires drawn in the same single or multiblock wire-drawing machine after passing through an annealing device are separated according to soft-annealed and unannealed hard drawn wires, and in each case are wound onto at least one spool. In this way it is possible for the wires used for a stranded conductor to be produced from the same predrawn material and on the same multiblock wire-drawing machine.

An alternative variation of the present method preferably allows for the wire(s) hard drawn in at least one single or multiblock wire-drawing machine or drawing apparatus to be wound unannealed onto at least one spool, and separately, for the wires drawn in at least one further single or multiblock wire-drawing machine or drawing apparatus to be wound onto at least one spool after passing through the annealing device. An embodiment of this type with several single or multiblock wire-drawing machines will be used in particular for a higher number of wires for the required stranded conductor, so that for example several wire-drawing machines or a multiblock wire-drawing machine for the production of unannealed hard drawn wires, and at least one further single or multiblock wire-drawing machine for the production of soft-annealed wires is used, and the respective wires can be produced independently of each other.

Furthermore, it is preferably intended that the wire(s) are hard drawn with a deformation degree of >96% in the at least one single or multiblock wire-drawing machine or drawing apparatus. This embodiment of the method is particularly intended, then, when the wires are hard drawn in one or several drawing steps, which can comprise one or several stages, from a preferred material without an annealing process, to a final dimension or a final diameter, which is intended for the subsequent stranding into a strand. Through this, particularly good fatigue strengths with bending stresses and tensile strengths are given.

An alternative embodiment of the procedure preferably allows that the wire(s) are predrawn to an intermediate diameter in a single or multiblock wire-drawing machine or drawing apparatus in one or several drawing steps, and subsequently the wire(s) predrawn to an intermediate diameter are brought to an annealing device, and pass through this, and are wound onto the spool(s), subsequently the spool or spools are prepared for a following stranding method, whereby the drawn wire(s) are brought to a further single or multiblock wire-drawing machine, and are hard drawn to a final dimension in one or several drawing steps, and are twisted into a strand in the stranding machine. This embodiment has the advantage that the drawing process of a predrawn material with an output diameter to a final diameter of the wire to be stranded takes place in at least two drawing steps, with at least one annealing process being carried out between two drawing steps. Through this, it is possible that tensile strengths of at least 300N/mm$^2$, preferably of more than 400N/mm$^2$, can be achieved.

According to a further alternative embodiment of the procedure, it is intended that the wire(s) are predrawn, in one or several drawing steps, in at least one single or multiblock wire-drawing machine or drawing apparatus, to an intermediate diameter, the wire(s) predrawn to an intermediate diameter pass through an annealing device, subsequently the drawn and soft-annealed wires are brought to a further single or multiblock wire-drawing machine, and are hard drawn in one or several drawing steps to a final diameter, and preferably wound onto the spool or spools, and in particular are prepared for the subsequent stranding method of the stranding machine. This method comprises, in principle, the same advantages as the existing procedure, and differs in that the hard drawing method of the drawn and soft-annealed wires immediately connects to the annealing process. Therefore the subsequent stranding procedure can be completely maintained thus far. In the here described method, the present production of soft-annealed wires can be maintained in principle, with the stranding method being modified by an upstream drawing method with one or several drawing steps.

In a preferred development of the method comprising at least two drawing steps, with an annealing process in between, it is intended that the soft-annealed wires predrawn to an intermediate diameter in the single or multiblock wire-drawing machine or drawing device in one or several drawing steps, are hard drawn to a final diameter with a deformation degree of less than 96%. The wires can be drawn to the intermediate diameter with one or several drawing steps. Through this, wires can be produced which again have a tensile strength of at least 300N/mm$^2$, in particular a tensile strength of at least 400N/mm$^2$.

In a further preferred embodiment of the method, it is intended that the wire(s) hard drawn or only without an annealing process, or the wire(s) which are predrawn and soft-annealed and subsequently hard drawn to a final diameter in at least one drawing step, and soft-annealed wire(s) are twisted into a strand by a stranding machine. Through this, a flexible adaptation of the mechanical properties of the strand is made possible, depending on the number of the wires used for the stranded conductor in each case, produced by different process steps.

Furthermore, it is preferably intended that the wires are hard drawn to a final diameter of 0.10 mm to 1 mm, in one or several drawing steps with one or several stages of each drawing step. Diameters of this type are particularly intended for wires which are used for a strand in automobile manufacture or similar.

According to a further preferred embodiment of the procedure it is intended that all the wires are produced from the same material. This facilitates an ease of cutting the strands or the ready insulated conductor to length, as well as a simpler recycling of strands of this type or of the ready insulated conductor.

The object of the invention is achieved, furthermore, by a strand, in particular as a conductor for motor vehicles, which comprises a stranded conductor of one or several hard drawn wires, or one or several wires hard drawn in a last drawing step before the stranding, or a mixture of one or several hard drawn wires of this type or of one or several soft-annealed wires, and that hard drawn wires of this type have a tensile strength of at least 300N/mm$^2$. Through this, a specific adaptation to the respective mechanical properties required can take place, whereby in particular, through the wires hard drawn in a last drawing step, or wires drawn without an annealing process, a reduced total cross-section of the strand, compared with a similar structure with exclusively soft-annealed wires, can be achieved, and therefore also results in a weight reduction.

It is preferably intended that the hard drawn wires are provided with a diameter of between 0.10 mm and 0.37 mm, which feature a tensile strength from 300N/mm$^2$ to 800N/mm$^2$, preferably greater than 400N/mm$^2$. Hard drawn wires of this type feature a higher tensile strength compared with soft-annealed wires. Soft-annealed wires with the same diameter, which are made of the same material as the unannealed wires, have a tensile strength of between 200N/mm$^2$ and 300N/mm$^2$, for example.

Furthermore, it is preferably intended that the hard drawn wires with a diameter of between 0.10 mm and 0.37 mm feature an elongation capability of between 0.1% and 10%, preferably less than 2%, and, specifically, preferably between 0.4% and 1%. This elongation capability is lower in comparison with soft-annealed wires. The soft-annealed wires with an identical diameter and made of the same material feature an elongation capability of more than 10%.

Furthermore, it is preferably intended that a stranded conductor with for example seven individual wires of hard drawn wires has a strand cross-section of 0.22 mm$^2$, and corresponds in material properties to an identical stranded conductor with seven soft-annealed wires, which has a strand cross-section of 0.35 mm$^2$. Through this, for nearly all mechanical properties, due to the structure of the strand according to the invention with hard drawn wires, a reduction of 0.13 mm$^2$, for example, can be achieved. This represents a saving of about 37% of the cross-section surface. Additionally, in analogy, a corresponding saving of weight, and thus also material costs, can take place. A similar reduction of 0.5 mm$^2$ of a cross-section of a strand with hard drawn wires to 0.35 mm$^2$ is possible with the use of unannealed wires. Further similar reductions are given corresponding to the other cross-sections.

According to a further preferred embodiment of the invention it is intended that for the unannealed as well as the annealed wires, tough-pitch copper types, so oxygen-containing copper types, such as Cu-ETP1, Cu-ETP or Cu—FRHC, or oxygen-free copper types, such as Cu—OF1, Cu—OF or Cu—PHCE, or a copper-magnesium alloy, are used. Surprisingly, it has been established that for the above named copper types, the omission of the annealing process or an intermediate annealing for the production of wires and a subsequent stranding of these wires in the strand according to the invention leads to a reduced cross-section and a saving of weight. A copper alloy is preferably intended for the production of all the wires required for a stranded conductor of a strand. The use of a copper-magnesium alloy, in particular according to DIN 17666, has the advantage that an increased strength is given. Additionally, analogous to the application of copper wires, the reduction of cross-sections can also take place in the construction of a strand. Preferably, an alloy of CuMg 0.1 to CuMg 0.4 is used. These have tensile strengths of more than 300N/mm$^2$.

According to a preferred embodiment of the strand, it is intended that for the stranded conductor, only wires of the same material are used. Through the use of the same material, there is no danger of electrocorrosion. Additionally, a simplification of production planning is given, as the same predrawn wires are processed.

The invention, as well as advantageous embodiments and further developments of the same, are described in more detail and explained in the following examples presented in the drawings. The characteristics to be taken from the descriptions and the drawings can be applied individually or severally in any combination according to the invention.

Figure 5:
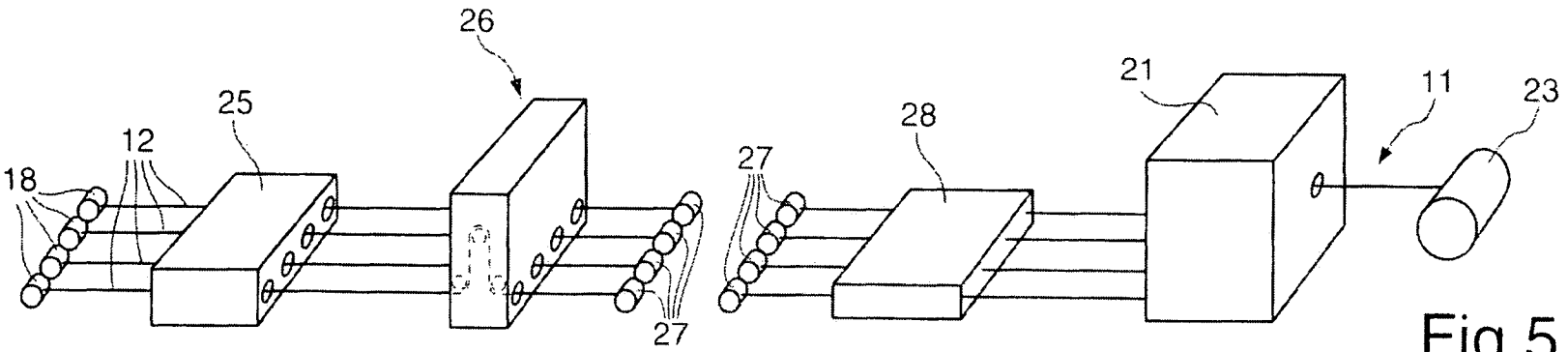
Figure 6:
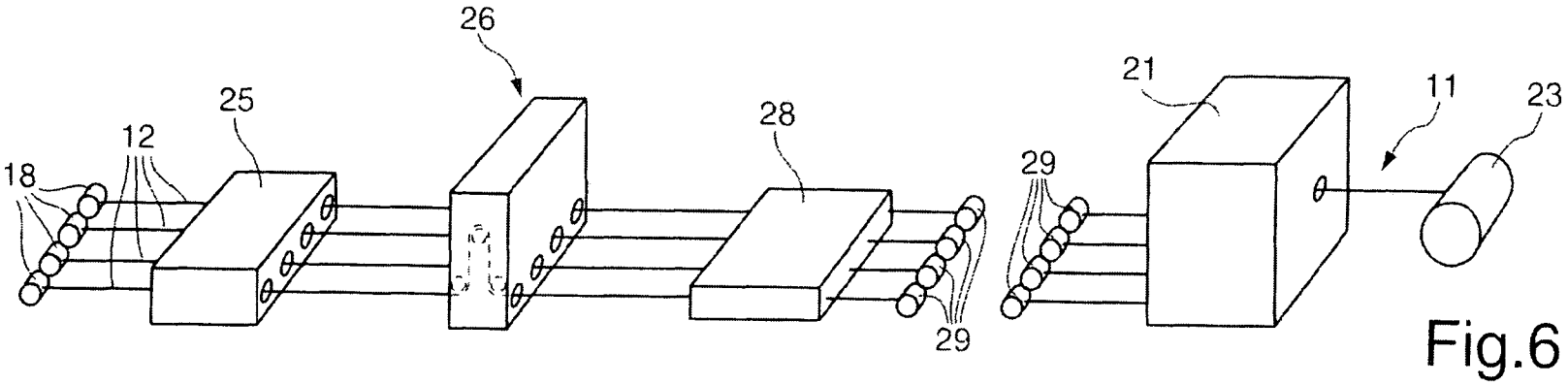
Figure 7:
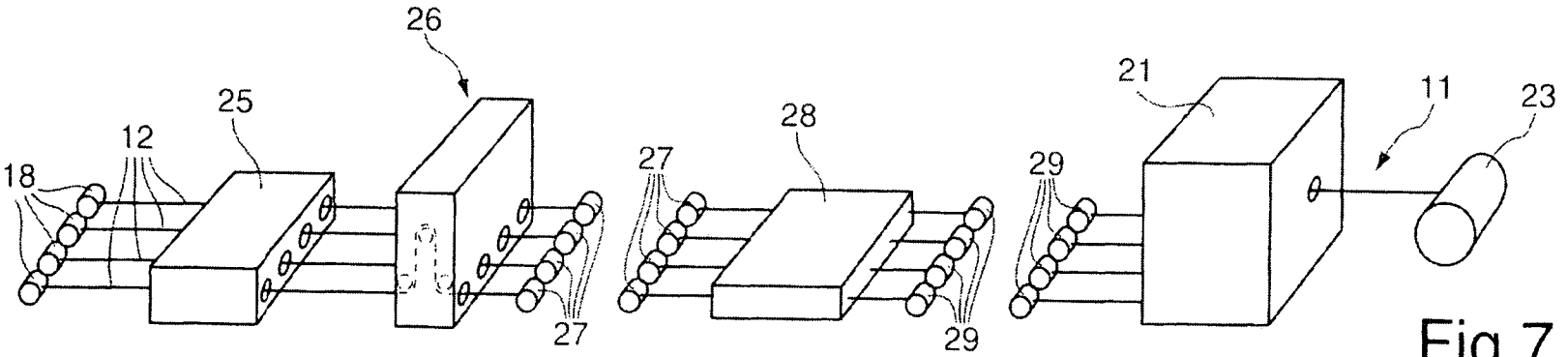

In the drawings:

FIGS. 1*a* and *b* show a diagrammatic sectional view and side section of a first embodiment of a strand according to the invention, FIGS. 2*a* and *b* show a diagrammatic sectional view and side section of an embodiment alternative to FIGS. 1*a* and *b*, FIGS. 3*a* and *b* show a diagrammatic sectional view and side section of a further embodiment alternative to FIGS. 1*a* and *b*, FIG. 4 shows a diagrammatic simplified representation of the process steps for the production of a first embodiment of a strand, FIG. 5 shows a diagrammatic simplified representation of the process steps for the production of a further embodiment of a strand, FIG. 6 shows a diagrammatic simplified representation of alternative process steps for the production of a strand according to FIG. 5, and FIG. 7 shows a diagrammatic simplified representation of further alternative process steps for the production of a strand according to FIG. 5.

In FIGS. 1*a* and *b*, a diagrammatic sectional view and side section of a first embodiment of the strand 11 is shown. This strand 11 comprises several wires 12. This embodiment relates to a core strand with a stranded conductor, which comprises a wire 12 with a central or concentric location.

This wire 12 in the central position is surrounded by a first layer of wires 14 formed of many wires 12, which for example comprises six wires. This first layer of wires 14 is surrounded by a second layer of wires 16 with, for example, twelve wires 12. In this core strand, the impact direction is opposed between the first layer of wires 14 and the second layer of wires 16. This emerges in FIG. 1*b*, for example. If the requirements are given, that a larger conductor cross-section is necessary for a core strand of this type, then, for example, a third layer of wires is again wound around the second layer of wires in an opposing impact direction, with for example, then, eighteen wires 12 being used.

In the case of the strand 11, used in particular as an electrical conductor for motor vehicles, strand 11 comprises as well as the strand 11 represented as a core strand with nineteen wires 12 according to FIGS. 1*a* and *b*, also a strand 11 which comprises a wire 12 in a central position and a first layer of wires 14 comprising six wires 12, so that in total seven wires 12 are stranded. An embodiment of this type will be used for example in vehicles as a vehicle conductor with reduced insulation, with the abbreviation FLRY. This embodiment with seven wires can have conductor cross-sections of 0.22 mm$^2$ and 0.35 mm$^2$. Furthermore, conductors with reduced insulation under the abbreviation FLRY are provided with nineteen wires, which comprise a structure according to FIGS. 1*a* and *b*, for example. These will be denoted as FLRY 0.5, FLRY 0.75, and FLRY 1.0, with regard to the strand cross-section. In addition, a further alternative embodiment of the strand 11 is used, which comprises 12, 16, 24 and 32 wires, and will be denoted as FLRY 0.35, FLRY 0.5, FLRY 0.75, and FLRY 1.0. Furthermore, preferable conductors with reduced insulation with further requirements are used, denoted as FLY 0.5, FLY 0.75, and FLY 1.0 with 16, 24 and 32 wires. The same applies to the heat-resistant vehicle conductors, denoted as FLYW or FLRYW. The embodiment of the strand 11 according to the invention, as well as its alternative embodiments, can be used in the place of the previously cited vehicle conductors.

The strand 11 can also be formed of so-called choke strands. In a choke strand of this type, the wires 12 are choked into the strand, that is to say that the wires 12 all have the same impact direction and impact length, however no definite position of the wires 12 in the strand 11. Several bundles of wires 12 can be choked into a strand 11, in order to produce a choke strand.

In FIGS. 2*a* and *b*, an embodiment of a strand 11 is represented as a core strand, alternative to FIGS. 1*a* and *b*. This embodiment is denoted as the so-called 'unilay-concentric embodiment'. In FIGS. 3*a* and *b*, a further preferred embodiment is represented, which is denoted as the so-called 'auto-unilay-concentric embodiment'. The embodiments differ in the position of the wires 12 within the layer of wires 14, 16 to the adjacent layer of wires 16, 14.

The strands 11 according to the invention, so core strands and choke strands, are produced from copper alloys, which correspond to the DIN EN13602, table number 1. These copper alloys comprise tough-pitch copper types, therefore copper types containing oxygen, but also as well as oxygen-free copper types. Furthermore, a copper-magnesium alloy can be intended according to DIN 17666.

The above described embodiment of strand 11, which is represented as a core strand in FIGS. 1 to 3, or can be constructed as a choke strand, features a stranded conductor which comprises exclusively hard-drawn wires 12, according to a first embodiment of the invention. In an alternative embodiment of the strand 11 according to the invention, it can be intended that the above described strand comprises at least one hard drawn wire 12 and at least one soft-annealed wire, so that a combination of at least one soft-annealed wire and at least one hard drawn wire is provided.

Many different combination possibilities can be intended, in particular for the core strand, for a stranded conductor consisting of at least one hard drawn and at least one soft-annealed wire 12. For example, according to FIGS. 1*a* and 1*b*, a strand 11 can comprise a wire 12 in a central position, formed of a soft-annealed wire 12, and six wires 12 in the first layer of wire 14, formed of unannealed or hard drawn wires 12. The second layer of wire 16, which surrounds the first layer of wire 14, is formed of soft-annealed wires. Likewise it can be intended, that for example the wire 12 in the central position is a hard drawn wire 12, and the first layer of wire 14 consists of hard drawn wires 12, as well as in the second layer of wire 16 consisting of soft-annealed wires 12. This embodiment also applies in an interchanged arrangement of the soft-annealed and hard drawn wires 12. For a combination of soft-annealed and hard drawn wires 12 for a strand 11, it is preferably intended that the individual layers of wire 14 and 16 are constructed uniformly, that is to say, that for a layer of wire 14, 16 either soft-annealed or hard drawn wires 12 are used. However, a mixture of the wires 12 within one layer of wire can also be intended.

For the construction of the strand 11 as a choke strand, it is particularly intended that several bundles of wire 12 are stranded into a choke strand, with each bundle consisting of one or several wires 12. Each bundle can feature soft-annealed and/or hard drawn wires 12. By 'hard drawn wires' 12, the following method of producing wires 12 described by the FIGS. 4 to 7 is understood.

In FIG. 4, a diagrammatic representation of each method step for the production of a first embodiment of the strand 11 is shown. For the production of a wire 12, individual untreated wires or so-called predrawn wires are prepared on spools 18 or baskets, or spools 18 with spun multi-end wires as predrawn wires, which for example are brought through a multiblock wire-drawing machine 19. Alternatively, each wire 12 can be brought through a single wire-drawing machine or a drawing apparatus. In this multiblock wire-drawing machine 19, the predrawn wires are drawn to a final diameter for example in one drawing step with several stages, and spun onto the spool(s) 20 dynamically or statically. In this multiblock wire-drawing machine 19, for example, one drawing step takes place, in which a predrawn wire with a diameter of 1.8 mm, for example, is drawn to an end diameter of 0.20 mm. An annealing process is not intended in this method. In fact, the wires 12 hard drawn without an annealing process, which are wound onto the spool(s) 20, are prepared for the stranding method. In this method, the spools 20 are brought through a stranding machine 21. Depending on the number of wires 12 for the strand 11, a corresponding number of wires 12 are removed from the spools 20 and stranded in the stranding machine 21. The produced strand 11 is wound onto a spool 23. After the stranding of the wires 12 into a strand 11 in the stranding machine 21, this product is further processed to a stranded conductor, and then prepared for further method steps, for example cutting to length or crimping or similar. In this method, it is intended that the deformation degree of the predrawn wires is greater than 96% for the hard drawn end wire 12 for processing into a strand. This means that the reduction in diameter of the predrawn wires for the hard drawn wire 12 is greater than 96%. The wires 12 produced in this method, as well as the strand 11 produced with wires 12 of this type, do not undergo an annealing treatment for recrystallisation of the brittleness of the wires 12.

Alternatively, it can be intended that with a higher number of wires 12 which should be stranded into a choke strand instead of a core strand, a subset of the wires 12 are wound onto a second spool 20 etc, until the number of wires 12 which are required for the stranded conductor are wound onto the spools 20. Subsequently, the wires 12 of all spools are unwound at the same time and brought through the stranding machine 21, so that all subsets of the wires 12 are stranded into a choke strand.

Through the application of wires 12 of this type, it is made possible, for example, that a strand 11 in cross-section can be reduced by at least one stage compared with the cross-section of a strand with conventional soft-annealed wires. In a classical gradation of strand cross-sections used thus far, 0.22 $mm^2$, 0.35 $mm^2$, 0.5 $mm^2$, 0.75 $mm^2$ and 1.0 $mm^2$, the nominal cross-section can thus be reduced, for example, by one or several stages in each case, so that in similar or identical mechanical properties and sufficient electrical properties, from now on cross-sections of 0.08 $mm^2$, 0.13 $mm^2$, 0.14 $mm^2$, 0.17 $mm^2$, 0.18 $mm^2$, 0.22 $mm^2$, 0.35 $mm^2$, 0.5 $mm^2$ and 0.75 $mm^2$ can be used.

According to a further alternative embodiment of the strand 11, it is intended that at least one hard drawn wire 12 and at least one soft-annealed wire are used for the stranded conductor. For the production of strands 11 of this type, a stranding machine 21, one or more spools 20 with hard drawn wires 12 and one or more spools of soft-annealed wires are prepared. An advantage can already be obtained in this embodiment, as a reduction in cross-section and therefore also a saving of material is made possible. This combination of soft-annealed and hard drawn wires 12 for a strand 11 can be used, in particular, for a stranded conductor with a higher number of wires 12.

A further alternative embodiment of the method for the production of a strand 11 is shown in FIG. 5. In this embodiment it is intended that prepared, predrawn wires on spools 18 or baskets are brought through a multiblock wire-drawing machine 25. In this multiblock wire-drawing machine 25, the predrawn wire is drawn to an intermediate diameter in one or several drawing steps with one or several stages. This predrawn wire 12 is subsequently brought to an annealing device 26, so that the structure of the predrawn wire 12 can recrystallise. Subsequently these predrawn and soft-annealed wires 12 are wound onto one or several spools 27. This spool 27 or spools 27 are prepared for a further processing procedure of the stranding machine 21, with the predrawn and soft-annealed wires 12 being brought through a further multiblock wire-drawing machine 28 or drawing apparatus before the stranding, which draws the predrawn and soft-annealed wire 12 to a final diameter in one or several drawing steps with one or several stages, with this wire being hard drawn in the further multiblock wire-drawing machine 28 or drawing apparatus. This hard drawn wire 12 is brought through the stranding machine 21, so that a strand 11 can be produced and wound onto the spool 23.

The wires 12, produced in the method according to FIG. 5, differ from the wires 12 produced in the method according to FIG. 4, in the respect that at least two drawing steps are intended, and an annealing treatment of the wire 12 predrawn to an intermediate diameter takes place between the at least two drawing steps. Thus the predrawn and soft-annealed wire 12 is hard drawn from an intermediate diameter to a final diameter. In this method it is preferably intended that the deformation degree in the last drawing step is less than 96%. The previously achieved drawing step(s) before the annealing process are determined depending on the output diameter and the required intermediate diameter. This low deformation degree of less than 96% is enough to transfer the single wire(s) to a hard drawn wire or wires, which feature a tensile strength of at least 300N/mm$^2$, preferably of more than 400N/mm$^2$.

The production method shown in FIG. 5 has the advantage, that the production of a wire predrawn to an intermediate diameter and soft-annealed, can take place through already available wire-drawing machines for soft-annealed wires, with simply one adaptation to the drawing stages taking place, so an appropriate choice of drawing stage, in order to produce the subsequent hard drawn single wire diameter.

Alternative to FIG. 5, an embodiment of the method is shown in FIG. 6. This embodiment differs in that the further multiblock wire-drawing machine 28 or wire-drawing machine is immediately downstream of the annealing device 26, so that the wires 12 are wound onto the spool 29 or spools 29, which are hard drawn to a final dimension and are wound onto the spool 29 or spools 29 in one or several drawing steps after the annealing process. The deformation degree of this multiblock wire-drawing machine 28 or drawing apparatus is less than 96%. On that basis, accordingly, the deformation degree of the multiblock wire-drawing machine 25 or multiblock wire-drawing machines 25 is to be set to taper the predrawn wire to the desired final diameter of the of the wire 12, which is intended for stranding in the stranding machine 21.

The production method shown in FIG. 7 has the same chronological sequence as the methods described in FIGS. 5 and 6. The method shown in FIG. 7 differs from the method shown in FIG. 6, in that similar to FIG. 5, the wires 12 drawn to an intermediate diameter following a first drawing step in the multiblock wire-drawing machine 25 or the drawing apparatus and an annealing device 26, are wound onto spools 27. Subsequently, these can be prepared for one or several multiblock wire-drawing machines 28 or drawing apparatus, so that the drawing step takes place with a deformation degree of less than 96% in a separate workstation. Subsequently the wires 12 hard drawn to a final diameter are wound onto spools 29, which, as described in FIGS. 4 and 6, will be prepared in a stranding machine 21 for the production of a strand 11.

Such an interruption of the online method, how this is achieved between the annealing device 26 and the multiblock wire-drawing machine 28 in FIG. 7, can alternatively take place between the multiblock wire-drawing machine 25 and the annealing device 26. Interruptions of this type can be intended depending on the modularity.

In the embodiments described above according to FIGS. 4 to 7, several multiblock wire-drawing machines or one or several single wire-drawing machines, or one or several drawing apparatuses, or a combination thereof can be provided in the place of a multiblock wire-drawing machine 19, 25, 28.

The production method of wires 12 for a strand 11 described in FIGS. 4 to 6, concerns a stranded conductor of exclusively hard drawn wires 12, or of predrawn and soft-annealed and subsequently hard drawn wires 12.

Any combination of the hard drawn wires 12 with the predrawn and soft-annealed and subsequently hard drawn wires 12 is possible for the production of a strand. Correspondingly, the spools 20 or 29 are arranged according to the respective required number of wires 12 for a strand 11 of the stranding machine 21. Furthermore, it can be intended that a hard drawn wire 12 and a soft-annealed wire known in the prior art are stranded together. Equally, at least one predrawn, soft-annealed and subsequently hard drawn wire 12 can be stranded with a soft-annealed wire known in the prior art. Equally, a combination of both named alternatives can be given.

If a mixture of the wires 12 of hard drawn wires 12 and/or soft-annealed wires should take place, these soft-annealed wires can be brought directly adjacent to the multiblock wire-drawing machine 28 or drawing apparatus of the stranding machine 21, so that also any such combination of wires 12 for the production of a strand 11 is made possible.

Depending on the assignment of the individual spools 20, 27 and/or 29 and/or of the spools of wires drawn to an end diameter and soft-annealed, different combinations of core strands or choke strands are made possible.

The wires described in the present description and in the claims can also be prepared as single wires on spools or baskets and also as multi-end wires on spools or baskets.

Further combinations and variants are also possible depending on the stranded conductor.

The invention claimed is:

1. Method of production of a strand of several wires consisting of an electrically conductive material, in which the wires are hard drawn to a final diameter in at least one wire-drawing machine in at least one drawing step so that the wires have in each case a tensile strength of at least 300N/mm$^2$, and that the hard drawn wires are subsequently stranded without a subsequent annealing process into a strand in a stranding machine, wherein the wires of a predrawn material are hard drawn to a final diameter with a deformation degree of more than 96% without an annealing process in the at least one wire-drawing machine.

2. Method according to claim 1, wherein the intended number of wires for the strand are produced in the at least one drawing step in the at least one wire-drawing machine and are wound onto at least one spool without an annealing process, and the at least one spool is prepared for the subsequent stranding process of the stranding machine.

3. Method according to claim 1, wherein the wires are hard drawn to a final dimension of 0.10 mm to 1 mm in the at least one drawing step.

4. Method according to claim 1, wherein the wires with a diameter of 0.10 mm to 0.37 mm are hard drawn and have a tensile strength of between 300N/mm$^2$ and 800N/mm$^2$.

5. Method according to claim 4, wherein the wires have a tensile strength greater than 400N/mm$^2$.

6. Method according to claim 1, wherein the hard drawn wires with a diameter of 0.10 mm to 0.37 mm are hard drawn and have an elongation capability of 0.1% to 10%.

7. Method according to claim 6, wherein the hard drawn wires have an elongation capability of less than 2%.

8. Method according to claim 7, wherein the hard drawn wires have an elongation capability of 0.4% to 1%.

9. Method according to claim 1, wherein the wires are produced from one of a tough-pitch copper type, an oxygen-free copper type, a copper-magnesium alloy, and a copper type and a copper-magnesium-alloy.

10. Method according to claim 9, wherein the tough-pitch copper type is selected from the group consisting of Cu-ETP, Cu-ETP1, and Cu—FRHC, and wherein the oxygen-free copper type is selected from the group consisting of Cu—OF1, Cu—OF, and Cu—PHCE.

11. Method according to claim 1, wherein the wires are prepared as one of single wires and multi-end wires for the production of a strand.

12. Method of production of a strand of several wires consisting of an electrically conductive material, in which the wires are hard drawn to a final diameter in at least one wire-drawing machine in at least one drawing step so that the wires have in each case a tensile strength of at least 300N/mm$^2$, and that the hard drawn wires are subsequently stranded without a subsequent annealing process into a strand in a stranding machine, wherein the wires are predrawn to an intermediate diameter in a wire-drawing machine, the wires predrawn to an intermediate diameter are brought to an annealing device, the predrawn and soft-annealed wires are brought to a further wire-drawing machine, and are hard drawn to a final diameter, and the predrawn and soft-annealed wire or wires are hard drawn to a final diameter with a deformation degree of less than 96% in the further wire-drawing machine.

13. Method according to claim 12, wherein the predrawn and soft-annealed wires are wound onto at least one spool, the at least one spool with predrawn and soft-annealed wires is brought to a further wire-drawing machine, and the predrawn and soft-annealed wires are hard drawn to a final diameter, and subsequently are stranded into a strand in the stranding machine.

* * * * *